United States Patent [19]

Pez et al.

[11] Patent Number: 4,580,404

[45] Date of Patent: Apr. 8, 1986

[54] METHOD FOR ADSORBING AND STORING HYDROGEN AT CRYOGENIC TEMPERATURES

[75] Inventors: Guido P. Pez, Allentown; William A. Steyert, Center Valley, both of Pa.

[73] Assignee: Air Products and Chemicals, Inc., Allentown, Pa.

[21] Appl. No.: 764,150

[22] Filed: Aug. 9, 1985

Related U.S. Application Data

[63] Continuation-in-part of Ser. No. 576,838, Feb. 3, 1984, abandoned.

[51] Int. Cl.[4] ..... B01D 8/00

[52] U.S. Cl. ..... 62/55.5; 62/48; 62/100; 62/268; 55/269; 417/901

[58] Field of Search ..... 62/48, 55.5, 268, 100; 55/269; 417/901; 423/248

[56] References Cited

U.S. PATENT DOCUMENTS

| | | | |
|---|---|---|---|
| 1,705,482 | 3/1929 | Keyes | 62/45 |
| 1,901,446 | 3/1933 | Heylandt | 62/45 |
| 2,626,930 | 1/1953 | Savage | 62/45 |
| 2,760,598 | 8/1956 | Dietz et al. | 62/45 |
| 3,350,229 | 10/1967 | Justi | 62/45 |
| 3,387,767 | 6/1968 | Hecht | 62/45 |
| 3,668,881 | 6/1972 | Thibault et al. | 62/55.5 |
| 3,833,514 | 9/1974 | Wennerberg et al. | 252/444 |
| 4,077,788 | 3/1978 | Woollam | 62/55.5 |
| 4,082,694 | 4/1978 | Wennerberg et al. | 252/444 |
| 4,150,549 | 4/1979 | Longsworth | 62/55.5 |
| 4,211,537 | 7/1980 | Teitel | 62/55.5 |
| 4,219,588 | 8/1980 | Longsworth | 62/55.5 |
| 4,277,951 | 7/1981 | Longsworth | 62/55.5 |
| 4,325,220 | 4/1982 | McFarlin | 62/55.5 |
| 4,514,204 | 4/1985 | Bonney et al. | 62/41 |
| 4,530,213 | 7/1985 | Kadi | 62/55.5 |

OTHER PUBLICATIONS

Jaeckel, "Kleinste Drucke, ihre Messung und Erzeungung," Springer (1950), pp. 208–211.

Lamond et al., *Carbon,* 1:281–292 (1964) and 1:293–307 (1963).

Visser et al., "A Versatile Cryopump for Industrial Vacuum Systems," *Vacuum,* 27:175–180 (1977).

Marsh et al., *Carbon,* 1:269–279 (1964).

Longsworth, "Advances in Cryogenic Engineering," 23:658–668, Plenum Press (1978).

Hands, "Recent Developments in Cryopumping," *Vacuum,* 32:602–312 (1982).

*Primary Examiner*—Ronald C. Capossela

*Attorney, Agent, or Firm*—James C. Simmons; E. Eugene Innis

[57] ABSTRACT

Hydrogen is stored at cryogenic temperatures by adsorption on porous carbon having a nitrogen BET apparent surface area above about 1500 $m^2/g$. Hydrogen can be adsorbed and desorbed in the context of a cryopump, having as the pumping element a panel, having large particles of pressed porous carbon thereon.

23 Claims, 8 Drawing Figures

METHOD FOR ADSORBING AND STORING HYDROGEN AT CRYOGENIC TEMPERATURES

REFERENCE TO RELATED APPLICATION

This is a continuation-in-part of application Ser. No. 06/576,838, filed Feb. 3, 1984 now abandoned.

TECHNICAL FIELD

This invention relates relates to a pumping element for a cryopump, particularly for removal and/or storage of hydrogen.

BACKGROUND ART

The storage of hydrogen, as a gaseous fuel for the operation of fuel cells, has been proposed by Justi, U.S. Pat. No. 3,350,229. This reference appears to recite storage, at about −183° C. and atmospheric pressure, sorption of the order of 6 mmol/cm$^3$ of porous carbon, which has an apparent density of 0.44 g/cm$^3$. This corresponds roughly to a hydrogen adsorption capacity of 13.6 mmol/g. However, this figure is derived from an imaginary "adsorption capacity," expressed in terms of cm$^3$ of hydrogen, reduced to 760 torr at 0° C., per cm$^3$ of adsorbent, measured at −183° C., cited by Jaeckel, "Kleinste Drucke ihre Messung and Erzeugung," Springer-Verlag, Berlin (1950) at page 210. Measured values for hydrogen adsorption at 1 atmosphere at cryogenic temperatures (−197° C. to −185° C.) of various carbons fall in a range between about 7.3 and 8.7 mmol of hydrogen/g of the carbon.

Heyland, in U.S. Pat. No. 1,901,446, has proposed storing liquefied gases on bodies such as silica gel or charcoal, indicating that silica gel is the better adsorbent.

It has been proposed by Teitel, in U.S. Pat. No. 4,211,537, to store hydrogen in a supply means, comprising a metal hydride hydrogen storage component and a microcavity hydrogen storage component, which in tandem provide hydrogen to an apparatus requiring hydrogen.

Woollam (U.S. Pat. No. 4,077,788) recites storage of atomic hydrogen, at liquid helium temperatures, in the presence of a strong magnetic field, in exfoliated layered materials, such as molybdenum disulfide or graphite.

The use of porous carbon is suggested by Dietz et al. (U.S. Pat. No. 2,760,598) for storage of liquified gases, including liquid air, hydrogen or nitrogen. Savage (U.S. Pat. No. 2,626,930) has proposed using chemically active graphitic carbon for adsorption of gases.

Modification of carbon with metallic salts has been disclosed by Keyes (U.S. Pat. No. 1,705,482) to produce a material appropriate for the storage of gas or liquid materials.

Hecht, in U.S. Pat. No. 3,387,767, has recited a cryosorption pumping element for a high vacuum pump, comprising a mass of sintered fibers and sorbent powders.

Other methods proposed for the storage or transportation of hydrogen include the use of metal hydrides and chemial hydrogenation/dehydrogenation. Metal hydride systems have been investigated extensively, for example, storage of hydrogen as iron titanium hydride $FeTiH_{1.95}$, see, Reilly, "Applications of Metal Hydrides," in Andresen et al., ed., "Hydrides for Energy Storage," New York, Pergamon Press (1978).

Presently available cryopump adsorption elements have limited capacity for hydrogen, because attempts to increase the capacity of the cryoadsorption elements by using adsorbents of large particle size have been unsuccessful. The unacceptability of cryoadsorption elements made from large granules of adsorbent has been attributed to decreased thermal conductivity and decreased diffusion, inherent in large adsorbent granules. Prior art cryoadsorption elements therefore have been constructed from irregularly-shaped carbon particles having an average diameter of about 1 mm for maintainance of acceptable diffusion and thermal conductivity properties. See, Hands, "Recent Developments in Cryopumping," *Vacuum*, vol. 32, pages 603–612 (1982) and Visser et al., "A Versatile Cryopump for Industrial Vacuum Systems," *Vacuum*, vol. 27, pages 175–180 (1977).

Hydrogen can also be stored in heavy metal cylinders, so as to avoid the cost of liquefaction. However, use of cylinders is not particularly attractive economically.

There is, accordingly, a need for improved methods of adsorbing and storing hydrogen, particularly at cryogenic temperatures.

It is an object of this invention to provide an improved method, using carbon, having a high nitrogen BET apparent surface area, for rapidly adsorbing and storing hydrogen in the context of cryogenic pumping.

DISCLOSURE OF INVENTION

This invention relates, in a high vacuum pump comprising a cryosorption pumping element and means for cooling the pumping element to the cryogenic temperature range, to the improvement wherein the pumping element comprises porous carbon particles, having a nitrogen BET apparent surface area above about 1500 m$^2$/g and dimensions greater than about 1.5×1.5×1.5 mm or 12×14 mesh, measured by U.S. Standard Testing Sieves, ASTM E-11.

This invention further relates to a panel assembly for a cryoadsorption pump, comprising a high thermal conductivity metal panel adapted for cooling by a cryogenic fluid, the metal panel having mounted thereon a plate of porous carbon particles having a nitrogen BET apparent surface area above 1500 m$^2$/g and dimensions above about 1.5×1.5×1.5 mm.

In another aspect, this invention relates to a method for maintaining high initial hydrogen pumping speed, characteristic of adsorbent carbon particles of 1–1.5 mm or smaller, in a high vacuum pump comprising a cryoadsorption pumping element and means for cooling the pumping element to the cryogenic temperature range, comprising using as the pumping element porous carbon particles having a nitrogen BET apparent surface area above 1500 m$^2$/g and dimensions above about 1.5×1.5×1.5 mm.

The surface area of carbon adsorbents is essentially controlled by the graphitic structure of the carbon. In an ideal system, one atom of adsorbate is adsorbed between two layers of graphite. The carbon atoms of graphite are arranged in planar layers, approximating a polycyclic aromatic of unlimited extent. The carbon atoms are arranged in a hexagonal pattern, each carbon atom being connected to three other carbon atoms by bonds of equal length, disposed at an angle of 120° with respect to each other. The bond length is about 1.415 Å. These assumptions permit calculation of a total area, on both sides of a isolated sheet one atom thick, of 2610 square meters per gram. For the case of absorbate, adsorbed between two layers of graphite, the maximum surface area would be about 1300 $m^2/g$.

However, the measured areas of the Amoco carbons, described below, which can be used in the practice of this invention, exceed this estimate, based on a geometrical maximum. On initial consideration, it is difficult to understand how a structure can have a higher surface area than "theoretically" possible.

This apparent anomaly can be explained by the fact that the the "measured" surface area of an adsorbent may not, in certain cases, represent an area determinable by direct measurements. The surface area is determined, instead, by the almost universally-used BET method, which is based on a theoretical model describing adsorption of a vapor on an isolated flat surface. See, Brunauer et al., *J. Am. Chem. Soc.*, vol. 60 (1938) at 309.

The measurement actually made is that of nitrogen adsorption, at very low temperatures, over a range of pressures. The raw data are processed by an equation, developed from the model, which yields a resulting area, corresponding to the area of the isolated flat surface of the model.

Although the assumptions used have been criticized, it should be kept in mind that nitrogen BET "apparent surface area" measurements generally agree with values of surface areas, obtained by other methods. These methods include those approaching actual physical measurement of area, such as direct microscopic observation of adsorption on glass spheres and geometric measurements on single crystals of metals. In view of their simplicity and reliability, generally, BET apparent surface areas are widely accepted without necessarily appreciating or clearly stating their indirect nature.

It is proposed that, in materials like the Amoco carbons, there are regions in which two carbon surfaces are close enough to each other that adsorption or condensation of hydrogen/nitrogen occurs in a fashion more complex, than predicted using the BET model. Values, obtained by the standard calculations, may accordingly be substantially higher than "actual" surface area, on which condensation is occurring. As a result, carbons having unusually high nitrogen BET apparent surface areas may also have unusually high adsorptive capacities.

Porous carbons, which may be used in the practice of this invention, are those having a nitrogen BET apparent surface area above 1500 $m^2/g$. Among materials which meet this requirement are the so-called Amoco carbons, described in Wennerberg et al., U.S. Pat. No. 4,082,694, herein incorporated by reference. These carbons are made from coal and/or coke by admixture with hydrous potassium hydroxide and are characterized by a very high surface area and a substantially cage-like structure, exhibiting microporosity. The products described by Wennerberg et al. have an apparent surface area (nitrogen BET) of 1800–3000 $m^2/g$ for coal-derived carbons and of 3000–4000 $m^2/g$ for coke-derived carbons.

Another type of high surface area carbon useable in the practice of this invention is derived from polyvinylidene chloride. A material obtained by heating polyvinylidene chloride at 850° C. in an inert gas to produce a char and further heating in an oxidizing atomsphere of $CO_2$ at 850° C. to a burn-off of 24%, has a nitrogen BET apparent surface area above 2300 $m^2/g$. Similarly high surface areas are obtained by burn-off of thus-prepared carbon at 1000° C. See, Lamond et al., *Carbon*, vol. 1 (1963) at page 295.

An additional carbon, having the requisite surface area, is made from polyfurfuryl alcohol by heating at 850° C. in an inert gas and further heating in carbon dioxide to a burn-off of at least 67%. See, Lamond et al., *Carbon*, vol. 3 (1964) at page 283.

The unpredictability of adsorption properties of typical carbons is apparent from FIG. 1, which shows hydrogen adsorption (Gibbs excess adsorption, $N_E$), reported in the literature, as a function of pressure at −197° C. Gibbs excess adsorption, $N_E$, is the excess material present in the pores beyond that which would be present under the normal density at the equilibrium pressure, Kidnay, *Adv. Cryogenic Engineering*, vol. 12 (1967) at page 730.

Total pore adsorption, $N_T$, is accordingly:

$$N_T = N_E + N_B$$

wherein $N_B$ is the amount of hydrogen which can be held, at normal density and equilibrium pressure, in the free pore volume remaining after adsorption. In relating $N_E$ to $N_T$, it was assumed that the free pore volume is the measured pore volume of adsorbent ($cm^3/g$ of carbon) minus the total molecular volume of hydrogen adsorbed at a given pressure. The molecular volume of hydrogen was calculated using the value of the constant b (0.02661 L/mole) from van der Waal's equation.

The behavior of coconut shell charcoal, Barneby-Cheney type IG-1, with a surface area about 1020 $m^2/g$, is shown in line (1), Kidnay et al., supra.

The adsorption of Carbotox, a pure charcoal (Lurgi Gesellschaft) is noted at point (2), Van Itterbeek et al, *Physica*, vol. 4 (1937) at page 389 and that of Fisher coconut charcoal, having a surface area about 1100 $m^2/g$ at point (3), Basmadjian, *Can. J. Chem.*, vol. 38 (1960) at page 141.

Line (4) shows the reported behavior of coconut charcoal, Barneby-Cheney type GI (surface area 1200–1400 $m^2/g$), Tward et al., *Proc. Int. Cryog. Eng. Conf.* (9th), (1982) at page 34.

Adsorption of hydrogen by Carbopol $H_2$ is shown in line (5), Czaplinski et al., *Przemysl Chemiczny*, vol 37 (1958) at page 640, and that of Degussa activated carbon F12/300 (assumed surface area 1125 $m^2/g$) is shown by line (6), Carpetis et al., *Int. J Hydrogen Energy*, vol. 5 (1980) at page 539.

At −185.8° C., Columbia 6-G coconut shell activated carbon adsorbed 7.9 mmole of hydrogen/gram of carbon at 1 atmosphere, Maslan et al., *Separation Science*, vol. 7 (1972) at page 601.

It is seen that some presently-used carbons are relatively good adsorbents, the Degussa carbon having the highest hydrogen capacity at −196° C. reported to the present. At 10 atm hydrogen pressure, the Degussa carbon had a Gibbs excess adsorption of about 3 g hydrogen/100 g of carbon, or a total pore adsorption capacity, $N_T$, of about 3.5 g of hydrogen/100 g of carbon. However, the points and the lines in FIG. 1 also show that there is no precise correlation between surface area and hydrogen adsorption and that adsorption properties are unpredictable and must be determined experimentally.

It has been found that the properties of high surface area carbons, useful in the practice of this invention, are influenced by processing of the carbons, prior to use. Carbons in accordance with Wennerberg et al. U.S. Pat.

No. 4,082,694 have a high alkali content. It is preferred that this be removed by extraction with water, after which the carbon is dried in air.

Various methods of pretreating water-leached Amoco carbon were studied. It is preferred, to preserve the high surface area, to treat the air-dried carbon with a stream of nitrogen gas at 400°-600° C. until no further condensible materials are detected in the effluent stream.

Adsorption behavior of thus-prepared carbons, which have a nitrogen BET apparent surface area of 2900-3000 $m^2/g$, is shown in FIG. 2. The upper line, 2-1, is the hydrogen adsorption isotherm at −196° C. (liquid nitrogen) and the lower line, 2-2, represents the hydrogen adsorption isotherm at −186° C. (liquid argon). It will be apparent that adsorption is markedly affected by pressure, whereas adsorption for some prior art carbons, e.g., coconut charcoal (FIG. 1, line 1) is not.

It was found that treatment of carbons of Wennerberg et al. U.S. Pat. No. 4,082,694 with hydrogen at 600° C. reduced the oxygen content of the sample, but was accompanied by a decrease in surface area, pore volume and hydrogen adsorption. It is proposed that treatment with hydrogen led to elimination of some of the fine pores, initially present in the sample.

Slow gasification of carbons of Wennerberg et al. U.S. Pat. No. 4,082,694 with hydrogen was attempted, so as to amplify the surface area and pore volume. It was surprisingly found, after treatment at 800° C. to a weight loss of 32%, that the pore volume was increased (from 1.47 to 2.07 $cm^3/g$), with only a small decrease in surface area. However, the cryosorption properties of this sample were considerably poorer than of the nitrogen-treated sample. These results suggest that hydrogen treatment led to expansion of large pores, but not of the micropores, which are thought to be the major site of hydrogen adsorption.

Treatment of Wennerberg et al. U.S. Pat. No. 4,082,694 carbons with potassium in liquid ammonia and with lithium led to products which had lower hydrogen capacities than for the nitrogen-treated sample. These results were unexpected in view of reports that intercalation compounds of potassium in graphite interact with hydrogen at −210° to −77° C., Watanabe et al., *Proc. R. Soc. Lond.*, vol. A333 (1973) at 51.

Cryogenic temperatures contemplated for the purposes of this invention are below −100° C. More preferably, these temperatures are below about −150° C. It is preferred that the porous carbon have a surface area above about 2000 $m^2$/gram. More preferably, the porous carbon will have a nitrogen BET apparent surface area above about 2200 $m^2/g$ and a bulk density above about 0.25 $g/cm^3$. A most preferred, porous carbon has a cage-like structure which contributes to over 60% of its surface, as measured by phase contrast, high resolution spectroscopy. These particularly preferred carbons can be made by treating a carbonaceous feed with hydrous potassium hydroxide in an amount of 0.5-5 weights per weight of carbonaceous feed; precalcining the mixture of hydrous potassium hydroxide and carbonaceous feed at 315°-482° C. for 15 min-2 hr and calcining the thus pre-calcined feed at 704°-982° C. for 20 min-4 hr under an inert atmosphere.

A further attribute of the porous carbons, used in the practice of this invention, is their unexpectedly high adsorptive capacity at very low pressures, particularly below about 10 torr. It is therefore preferred to utilize these carbons under pressures below about 10 torr, more preferably below $10^{-2}$ torr and, most preferably, below $10^{-4}$ torr.

It will be understood that the porous carbon particles, used in making the cryopump assemblies of the present invention may be of regular or irregular shape. The particles can be in the form of cubes, cylinders, pellets or less-regularly shaped forms. In describing the dimension of the carbon particles, three parameters are used to denote the lengths of the x, y and z coordinates of the particles. In the case of a cube or sphere, each of the dimensions is identical. In the case of cylinders or pellets, the x and y coordinates represent the length of the shorter axis and the z coordinate the length of the longer one. Thus a particle designated as 1.5×1.5×1.5 mm in size could be a cube of the foregoing dimensions or a sphere of which the diameter is 1.5 mm. Particles described, for example, as 2×2×3 mm would include roughly cylindrical particles having a diameter of 2 mm and a length of 3 mm or pellets of the same dimensions. The particle size description can be abbreviated, using only two coordinates, either of which is the z coordinate. Therefore, particles described as 2×3 mm include cylinders and pellets having a diameter of 2 mm and length of 3 mm.

Alternatively, the dimensions of the particles can be evaluated by sieving, using ASTM E-11 (1961) standards. Prior art particles (1×1.5 mm) are 12×30 mesh (manufacturer's data). Particles 2×3 mm corresponded to 6×16 mesh (manufacturer's data) and 3×3 mm particles corresponded to 6×8 mesh. Particles of the requisite nitrogen BET apparent surface area and dimensions greater than 12×14 mesh are appropriate for use in the practice of this invention.

It is preferred in the practice of this invention to use carbon particles of size greater than about 2×2×2 mm and more preferably to use those of size above about 2.5×2.5×2.5 mm.

In low pressure application, the porous carbons of this invention can be used as pumping elements in high vacuum pumps comprising a cryosorption pumping element and means for cooling the pumping element. Preferably, the pumping element will be a panel, having porous carbon particles pressed thereon. It will be understood that pumping elements can have a variety of configurations, encompassed by the term "panels," and that the configurations contemplated are not intended to be limited to planar structures.

In a plate assembly for cryoadsorption pumps, as disclosed by Hecht, supra, or by McFarlin in U.S. Pat. No. 4,325,220, both incorporated herein by reference, the porous carbon can be mounted on a panel in the form of a pressed powder or, more preferably, mounted in the form of pellets.

Another type of panel structure is that disclosed by Longsworth, U.S. Pat. Nos. 4,150,549, 4,219,588 and 4,277,951, herein incorporated by reference. This structure is further disclosed by Longsworth, "Performance of a Cryopump Cooled by a Small Closed-Cycle 10K Refrigerator," *Advances in Cryogenic Engineering*, vol. 23, Plenum Press, New York (1978), at pages 658-668. The pumping surface comprises an extended surface, that is, one or more nested cylindrical surfaces, on which a gas adsorbing material is porous carbon. This configuration is preferred for pumping elements of the invention.

A further type of panel structure, embodying an extended surface is that described by Kadi, U.S. Pat. No.

4,530,213, herein incorporated by reference. The surface comprises a plurality of vertically-tiered conical sections or surfaces of revolution. Another type of extended surface is that of Bonney et al., U.S. Pat. No. 4,514,204, herein incorporated by reference, particularly cold panel 82. It is also preferred to use a panel, having an extended surface, in the practice of this invention.

Cryogenic pump elements made in accordance with the teachings of this invention using the high surface area carbons not only adsorb considerably more hydrogen than observed using otherwise identical prior art elements, but also permit maintainance of high initial pumping speeds, despite use of carbon granules considerably larger than those deemed acceptable in the prior art. This is apparent from FIGS. 4 and 5. In FIG. 4 is shown cryopump adsorption of hydrogen on coconut charcoal. This carbon adsorbed about 1.9 SL of hydrogen, before occurrence of a marked drop in adsorption rate. Total hydrogen adsorption for this panel was about 2.3 SL. However, the high surface area carbon, on a panel of the same size and shape, as shown in FIG. 5, adsorbed of the order of 11.4 SL of hydrogen before the adsorption rate dropped to half its initial value.

The standard coconut charcoal (estimated 27 g/panel, surface area about 929 $m^2/g$, $1\times1.5$ mm) adsorbed about 1.9 SL of hydrogen before the absorption rate dropped to half its starting value. The high surface area Amoco carbon (estimated 40 g/panel, surface area 2340 $m^2/g$, $3\times3$ mm) adsorbed about 11.4 SL of hydrogen.

As shown in FIGS. 6 and 7, large particles of prior art carbons, fabricated into pump panels, result in lower initial pumping rates than the large granules, useable for the practice of this invention, as well as the expected smaller capacity. As shown in FIG. 8, only small ($1\times1.5$ mm) prior art carbon granules produce pump elements in which hydrogen pumping speed is relatively constant and high until very near saturation.

The greatly enhanced adsorption properties of cryopump elements in accordance with the invention mean that a cryopump can be operated for much longer periods, without appreciable loss of pumping speeds, prior to shut down for regeneration, than possible heretofore.

BEST MODE FOR CARRYING OUT THE INVENTION

Figure 1:
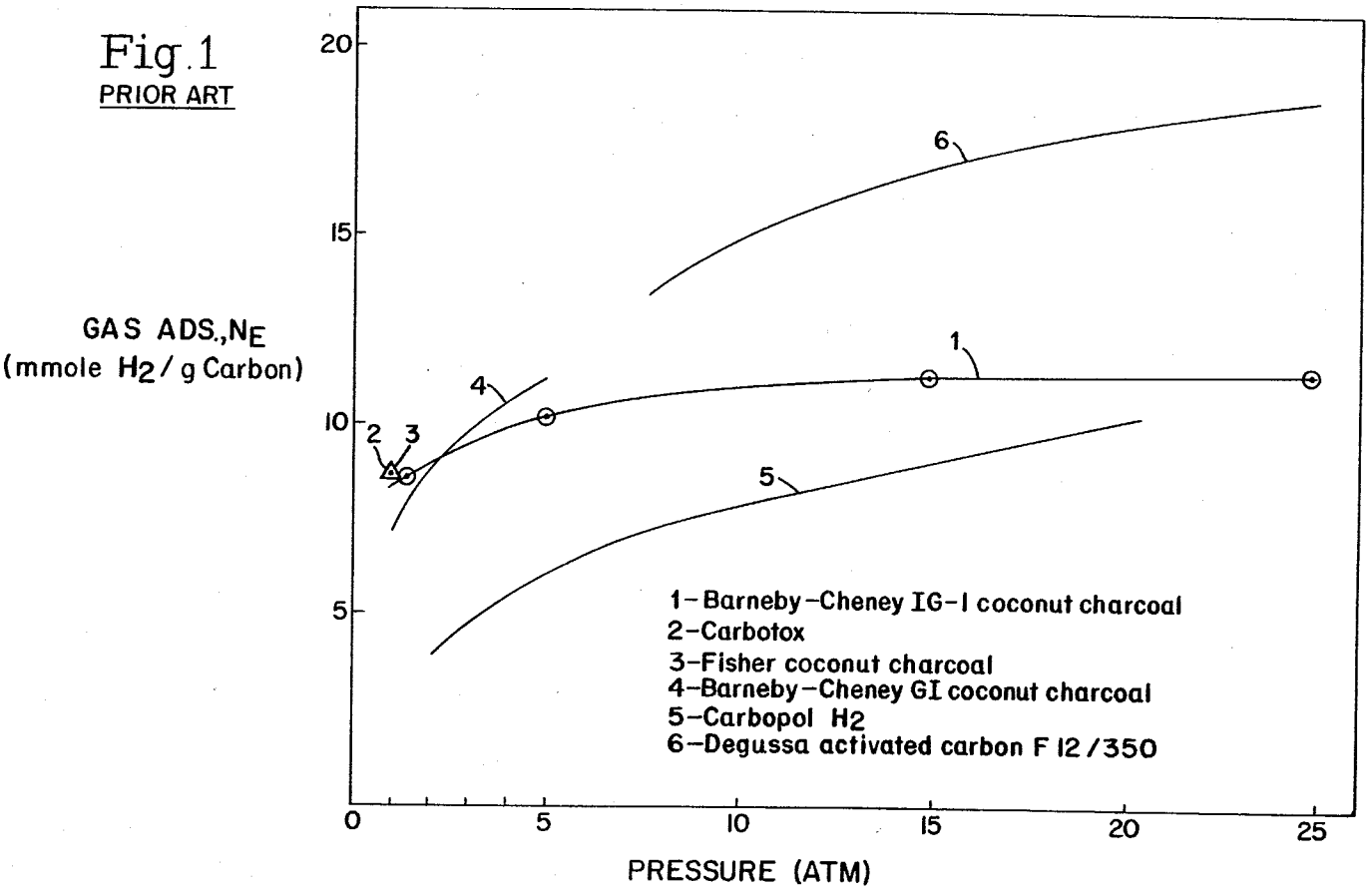
Fig. 1 PRIOR ART
In FIG. 1 are shown adsorption isotherms for prior art carbons at about 77° C.

In a preferred aspect, porous carbons used in the practice of this invention are those having a nitrogen BET apparent surface area above about 2000 $m^2/g$ and a particle size about about $2\times2\times2$ mm. The particle size is preferably above $2.5\times2.5\times2.5$ mm. Preferably, such a porous carbon will have a bulk density above about 0.25 $g/cm^3$ and a cage-like structure which contributes to over 60% of its surface, as measured by phase contrast, high resolution microscopy. The porous carbon can be made by treating a carbonaceous feed with hydrous potassium hydroxide in an amount of 0.5–5 weights per weight of carbonaceous feed; precalcining the mixture of hydrous potassium hydroxide and carbonaceous feed at 315°–482° C. for 15 min-2 hr and calcining the thus pre-calcined feed at 704°–982° C. for 20 min-4 hr under an inert atmosphere.

Most preferred utilization conditions are at pressures below $10^{-2}$ torr.

A most preferred configuration for a pumping element is a cylindrical panel or extended surface, having pressed porous carbon thereon.

Without further elaboration, it is believed that one skilled in the art can, using the preceding description, utilize the present invention to its fullest extent. The following preferred specific embodiments are, therefore, to be construed as merely illustrative and not illustrative of the remainder of the disclosure in any way whatsoever. In the following examples, the temperatures are set forth uncorrected in degrees Celsius. Unless otherwise indicated, all parts and percentages are by weight.

EXAMPLE 1

Super Sorb grade PX-21 carbon (Amoco Research Corp., Chicago, Ill., lot 78-10) had the following properties, tested in accordance with Wennerberg et al., U.S. Pat. No. 3,833,514, herein incorporated by reference:

SOCo BET surface area, $m^2/g$: 3792 (old), 3369 (new)
Digisorb BET surface area, $m^2/g$: 3143
Pore volume:
  pores>20 Å diam, $cm^3/g$ 0.8209
  pores<20 Å diam, $cm^3/g$ 1.48
Average pore diameter, Å: 24.638
Bulk density, $g/cm^3$: 0.345
pH of carbon: 4.0
Ash, wt %: 2.94
Water solubles, wt %: 2.25

This material was extracted in a Soxhlet extractor until no more potassium was removed. After the extracted carbon was dried in air, it was placed in a quartz tube and heated in a stream of nitrogen gas at 500° C. until no condensible volatiles were detected in the effluent gas stream. The resulting carbon was handled and stored under an inert atmosphere. The thus-prepared sample had a nitrogen BET apparent surface area of 2888 $m^2/g$ at liquid nitrogen temperature, determined using a Micromeritics Digisorb apparatus. The total pore volume of the carbon was taken as equal tö the volume of liquid nitrogen contained in the carbon pores at the saturation point.

Hydrogen adsorption isotherms up to about 30 atm (absolute pressure) were measured at −196° C. (liquid nitrogen) and −186° C. (liquid argon) using a conventional volumetric apparatus, consisting of a basic steel mainfold, Heise dial gauge (0–6000 kPa), MKS diaphragm gauge (1–10,000 mm Hg), Töpler pump for pumping non-condensible gases and a high vacuum source ($5\times10^{-6}$ torr). The carbon sample being tested was held in a steel vessel (30 $cm^3$, 2.54 cm inner diam) sealed with Conoseal (Aeroquip Corp.) steel flanges and gaskets. The vessel contained a porous metal disc to minimize the loss of carbon during outgassing. The manifold and pressure gauges were thermostatted as appropriate. The sample vessel was held at the required cryogenic temperature using liquid nitrogen (−196° C.) or liquid argon (−186° C.).

Prior to making the adsorption measurements, the carbon was outgassed overnight under a vacuum of $<5\times10^{-6}$ torr. Helium was used for dead volume measurements and adsorption of hydrogen at various pressures was measured.

The isotherms were calculated, using the virial equation:

$$PV=nRT(1+Bn/V+Cn^2/V^2),$$

using values for the virial coefficients B and C taken from Dymond et al., "The Virial Coefficients of Gases," Clarendon Press, Oxford (1969), page 158 for hydrogen and page 174 for He.

Figure 2:
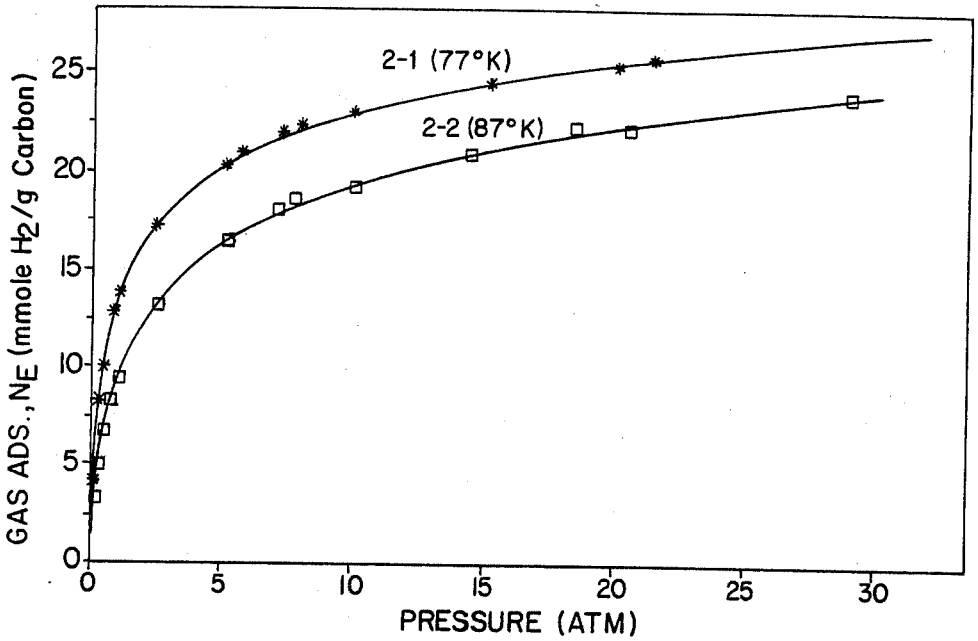
In FIG. 2 are shown adsorption isotherms for a high surface area carbon, used in the practice of this invention.

Experimental data at −196° C. and −186° C. are presented in Tables 1 and 2, respectively, and in FIG. 2. Results in Table 1 were checked by measuring the amount of hydrogen desorbed with decreasing pressure.

Hydrogen adsorption isotherms were fitted by the least squares procedure to the empirical equation:

$$P=\frac{1}{K}\cdot\frac{N_E}{(S-a\,N_E)^a}$$

In FIG. 2, the amount of hydrogen adsorbed, $N_E$, (Gibbs excess adsorption) is plotted against hydrogen pressure. At −196° C., hydrogen adsorption was 13.3, 22.8 and 25.4 mmol $H_2$/g of carbon at 1, 10 and 20 atm $H_2$, respectively. Total hydrogen storage capacity, including all of the hydrogen in a vessel containing cryoadsorbent, was about 5.4 g of $H_2$/g of carbon at 10 atm and −196° C.

The data of Tables 1 and 2 were used used to calculate isosteric heat of adsorption (q), defined by the equation:

$$q=\frac{R\ln P_2/P_1}{1/T_1-1/T_2}$$

TABLE 1

Hydrogen Adsorption on Amoco Carbon at −196° C.

| P (atm) | $N_{Ee}$ (mmol) | $N_{Ec}$ | $N_{Ee}-N_{Ec}$ | $\frac{N_{Ee}-N_{Ec}}{N_{Ee}}\times100$ |
|---|---|---|---|---|
| 0.0925 | 4.4625 | 4.2666 | 0.1959 | 3.490 |
| 0.4847 | 10.0593 | 10.2495 | −0.1902 | −1.8912 |
| 1.1159 | 13.7799 | 13.8309 | −0.0510 | −0.3701 |
| 7.9655 | 22.2604 | 22.0309 | 0.2295 | 1.0308 |
| 5.7401 | 20.8577 | 20.7459 | 0.1118 | 0.5360 |
| 20.0296 | 25.4327 | 25.4000 | 0.0327 | 0.1285 |
| 15.1937 | 24.4252 | 24.4304 | −0.0052 | −0.0213 |
| 10.0222 | 22.8218 | 22.9053 | −0.0835 | −0.3658 |
| 5.1468 | 20.2098 | 20.3086 | −0.0988 | −0.4891 |
| 2.5512 | 17.1858 | 17.3997 | −0.2139 | −1.2449 |
| 0.3217 | 8.4313 | 8.5731 | −0.1418 | −1.6823 |
| 0.9026 | 12.8225 | 12.9091 | −0.0866 | −0.6753 |
| 7.2986 | 21.8937 | 21.6922 | 0.2015 | 0.9203 |
| 21.3817 | 25.7433 | 25.6241 | 0.1192 | 0.4631 |
| 33.8219 | 26.8765 | 27.1414 | −0.2649 | −0.9856 |

K = 0.246015 D-09
A = 4.9020
S = 220.2911
$N_{Ee}=N_{E(exp)}$
$N_{Ec}=N_{(calc'd)}$

TABLE 2

Hydrogen Adsorption on Amoco Carbon at −186° C.

| P (atm) | $N_{Ee}$ (mmol) | $N_{Ec}$ | $N_{Ee}-N_{Ec}$ | $\frac{N_{Ee}-N_{Ec}}{N_{Ee}}\times100$ |
|---|---|---|---|---|
| 0.8168 | 8.3413 | 8.4833 | −0.1420 | −1.7019 |
| 7.1478 | 18.0389 | 17.8808 | 0.1581 | 0.8765 |
| 20.5329 | 22.1506 | 22.4140 | −0.2634 | −1.1889 |
| 14.5176 | 20.9099 | 20.9559 | −0.0460 | −0.2198 |
| 10.0716 | 19.2618 | 19.3826 | 0.1208 | 0.6720 |
| 5.1912 | 16.3767 | 16.4644 | −0.0877 | 0.5354 |
| 2.5907 | 13.1335 | 13.3751 | −0.2416 | −1.8394 |
| 0.3118 | 5.0346 | 5.0559 | −0.0214 | −0.4248 |
| 0.1999 | 3.9307 | 3.7897 | 0.1410 | 3.5862 |
| 0.5258 | 6.7453 | 6.8127 | −0.0673 | −0.9982 |
| 1.0313 | 9.3932 | 9.4229 | −0.0297 | −0.3158 |
| 7.7633 | 18.6461 | 18.2445 | 0.4016 | 2.1540 |
| 18.4259 | 22.1856 | 21.9624 | 0.2232 | 1.0060 |
| 28.9859 | 23.7065 | 23.8266 | −0.1201 | −0.5068 |

Figure 3:
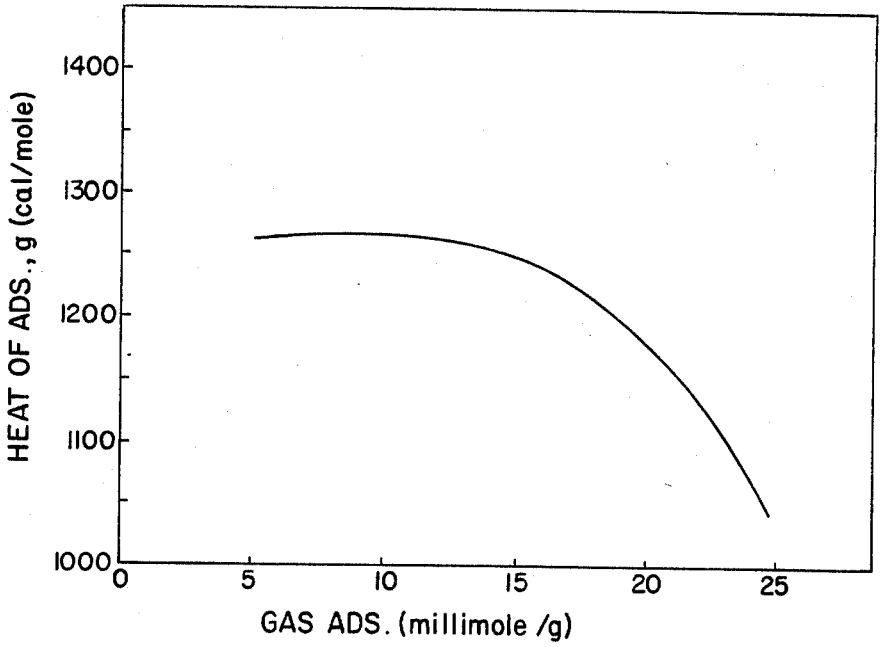
In FIG. 3 is shown variation of isosteric heat of adsorption of a typical carbon of the invention, at −196° C. to −186° C.

K = 0.250997 D-13
A = 6.0179
S = 319.5227
$N_{Ee}=N_{E(exp)}$
$N_{Ec}=N_{E(calc'd)}$ Results are shown in FIG. 3, in which q in cal/mol is plotted against $N_E$ in mmol $H_2$/g of carbon. As shown from the figure, isosteric heat of adsorption varies from about 1000 cal/mol to 1260 cal/mol, at higher levels of adsorption.

EXAMPLE 2

Modification of Amoco carbon was studied in order to correlate adsorption properties with modification.

An Amoco carbon sample, extracted with water and dried in air at room temperature, contained 1.2% ash and about 10% oxygen. As a result of heating this sample under a stream of nitrogen at 500° C., the oxygen content was lowered to 5.2%. The nitrogen BET apparent surface area, measured with nitrogen at −195.7° C., of a sample treated in this way was about 2900–3000 $m^2$/g. Pore volume ranged from 1.47 to 1.7 $cm^3$/g.

Properties of other samples, treated in various ways, are given in Table 3.

EXAMPLE 3

Hydrogen adsorption was determined at −196° C. for samples prepared in Example 2. As shown in Table 4, the carbon with the highest adsorptive capacity was that obtained by treating the sample received (batch 78-10) in a stream of nitrogen at 500° C. until no further volatiles were obtained. Although a similarly-treated sample of another batch (79-1) had a higher pore volume than the first sample, the level of hydrogen adsorption under cryogenic conditions was essentially the same. These results suggest that the relationship between adsorption and pore volume is not clearly understood at the present time.

A sample treated with hydrogen at 600° C. and then treated under vacuum ($<10^{-5}$ torr) at 900° C. had a lower surface area than the nitrogen-treated samples but a similar pore volume. However, the oxygen content of this sample was reduced to about 1.4%. It is proposed that the reaction with hydrogen caused elimination of some fine pores.

Attempts to improve the surface area and pore volume of the carbon by slow gasification with hydrogen at 800° C., to a weight loss of 32%, produced a material with higher pore volume (2.07 $cm^3$/g) and only slightly decreased surface area (2790 $m^2$/g).

TABLE 3

Hydrogen Adsorption ($N_E$) in mmol/g of Adsorbent on Treated Amoco Carbons and Zeolites

| Sample | BET ($N_2$) $m^2/g$ | Pore Vol. $cm^3/g$ | Gas Adsorbed at −196° C. (mmol/g) 1 atm | 10 atm | 20 atm |
|---|---|---|---|---|---|
| Amoco carbon (lot 78-10) nitrogen, 500° C.; 5.2% oxygen | 2888 | 1.472 | 13.3 | 22.8 | 25.4 |
| Amoco carbon (lot 79-1) 500° C., nitrogen | 3040 | 1.708 | 12.5 | 22.4 | 25.0 |
| Amoco carbon (lot 78-10) 900° C., hydrogen to 32% weight loss | 2366 | 1.667 | 10.5 | 19.8 | 21.6 |
| Amoco carbon (lot 78-10) 800° C. with hydrogen to 32% weight loss | 2793 | 2.075 | 11.5 | 19.0 | 20.9 |
| Amoco carbon (lot 78-10) 900° C. under vacuum; 1.5% oxygen | 2512 | 1.288 | 12.7 | 19.3 | 20.5 |
| Amoco carbon (lot 78-10) 600° C., hydrogen; 900° C., vacuum; doped with 7.8% Li | 1606 | — | 8.0 | 8.7 | 7.5 |
| Amoco carbon (lot 78-10) 600° C., hydrogen; doped with 13.5% K; 1.4% oxygen | 2525 | 1.333 | 11.7 | 16.8 | 16.3 |
| Y—Zeolite LZ—Y82 400° C., vacuum | 625 | — | 2.0 | 4.7 | 5.0 |
| Li/L3Z Zeolite 400° C., vacuum | — | — | 3.6 | 5.6 | 5.4 |

TABLE 4

Effect of Modification of Adsorbents on Adsorption of Hydrogen at −196° C.

| Adsorbent | BET ($N_2$) $m^2/g$ | $H_2$ Adsorption, 10 atm mmol/g | mmol/$m^2$ | $H_2$ Adsorption, 20 atm mmol/g | mmol/$m^2$ |
|---|---|---|---|---|---|
| Coconut charcoal | 1020 | 10.1 | 9.90 | 10.5 | 10.29 |
| Amoco carbon (78-10) | 2888 | 22.8 | 7.89 | 25.4 | 8.80 |
| Amoco carbon (79-1) | 3040 | 22.4 | 7.37 | 25.0 | 8.22 |
| Amoco carbon (78-10) | 2366 | 19.8 | 8.37 | 21.6 | 9.13 |
| Amoco carbon (78-10) | 2793 | 19.0 | 6.80 | 20.9 | 7.48 |
| Amoco carbon (78-10) | 2512 | 19.3 | 7.68 | 20.5 | 8.16 |
| Amoco carbon (78-10) | 1606 | 8.7 | 5.42 | 7.5 | 4.67 |
| Amoco carbon (78-10) | 2525 | 16.8 | 6.65 | 16.3 | 6.46 |
| Y Zeolite LZ—Y82 | 625 | 4.7 | 7.52 | 5.0 | 8.00 |

However, the product adsorbed less hydrogen under cryogenic conditions than the starting material. It is proposed that treatment with hydrogen caused expansion of larger pores, but not of the micropores, which are thought to be largely responsible for hydrogen adsorption.

Samples containing an alkali metal (lithium) were prepared by treating the carbon samples with hydrogen at 600° C. and then with potassium in liquid ammonia at about 20° C. The resulting solid samples were dried under vacuum at 300° C., and then used without any further purification. A lithium-doped carbon was also prepared. Neither of these materials was better than the carbon, untreated except with nitrogen at 500° C. Accordingly, the effect of alkali metal intercalation on hydrogen cryosorption is not clearly understood.

EXAMPLE 4

Densification of Amoco carbon samples was attempted so as to provide an adsorbent providing for maximum hydrogen storage per unit volume.

The material received from Amoco had a bulk density of about 0.3 $cm^3/g$. Interparticle void volume of this material was about 47% of the total volume of carbon.

Samples of this carbon in a 20 mm diameter steel dye were compressed under a force of 20,000 pounds. The pressing procedure was repeated with Amoco carbons, mixed with various binders. After the materials had returned to ambient pressure, the density, surface area and pore volumes were determined.

The following results were obtained:

| Treatment | Density ($g/cm^3$) | BET Surface Area ($m^2/g$) | Pore Volume ($cm^3/g$) |
|---|---|---|---|
| Amoco C (control) | 0.285 | 2966 | 1.548 |
| Pressed (41,000 psi) | 0.406 | 2586 | 1.359 |
| +10% bentonite, pressed | 0.503 | 2365 | 1.276 |
| +15% bentonite, pressed | 0.447 | — | — |
| +10% boric acid, pressed | 0.422 | — | — |

These results show that moderate compaction was accomplished and that the interparticle void was reduced from 47% to about 30% of the total volume. The sample loaded with 10% of bentonite clay had properties close to theoretical density, having only about 8% of interparticle void, calculated on the assumption that the density of clay is the same as that of "real" carbon density (about 2.68 $g/cm^3$). The results also showed that densification of the carbon brought about decrease in the nitrogen BET apparent surface area and pore volume. Consequently, some decrease in hydrogen cryoadsorption capacity may be expected when densified carbon samples are used.

EXAMPLE 5

The evaluation of two adsorbents in a cryopump was done in accordance with the following procedure: In the first evaluation Calgon coconut charcoal in the form of granules (12×30 mesh, 1×1.5 mm, nitrogen BET apparent surface area about 929 $m^2/g$) was mounted with the aid of an adhesive onto a standard cryopump panel, having an area of 458 $cm^2$. In the second evaluation, the Calgon coconut charcoal was replaced by Amoco carbon Type GX31 (lot 79-9) in the form of pellets (6×8 mesh, 3×3 mm, on an as received basis and having a nitrogen BET apparent surface area of 2340 $m^2/g$).

The evaluations were done using each of the foregoing panels in an HV-202-82 cryopump, admitting hydrogen at a constant flow rate and measuring resulting pressure. The temperatures during the experiments were −261° to −263° C. A mass flow rate of 10 $scm^3/min$ (0.127 TL/s) and a speed of 2000 L/s means that the cryopump maintained a pressure of $0.127/2000=6.3\times10^{-5}$ torr. Pumping speed was constant, and determined by geometry, until the adsorbent began to become saturated and hydrogen began to rebound, rather than being adsorbed when it contacted the adsorbent. The flow rate, used during the test, was selected so that hydrogen migrated to the interior of the adsorbent almost as fast as it was adsorbed on the surface. The test was run intermittently by stopping gas flow periodically to permit the system to recover. Slightly higher speeds were observed after the flow of gas was interrupted, because more open sites were available at the surface of the adsorbent.

Figure 4:
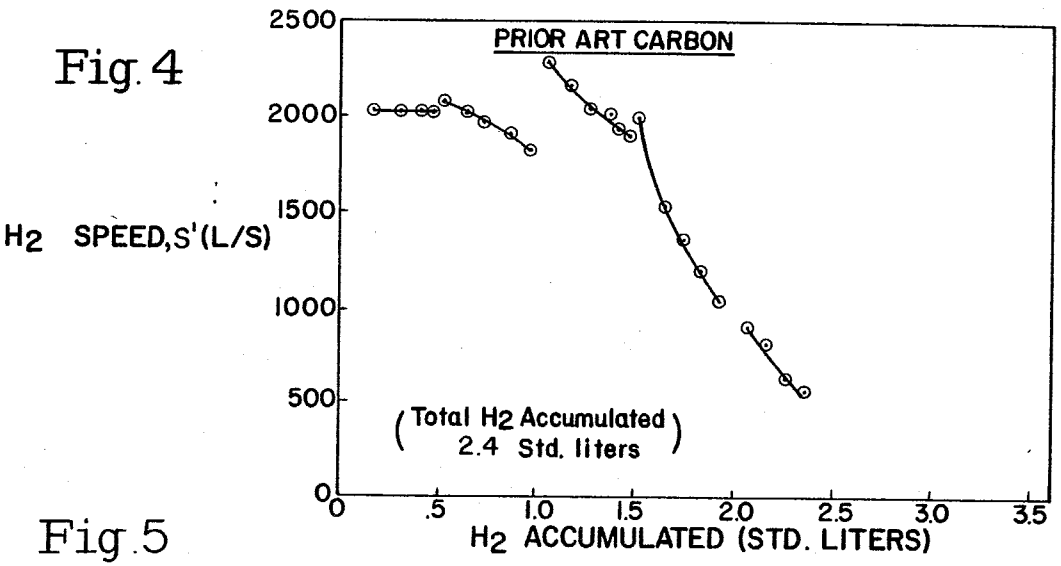
In FIGS. 4 and 5, respectively, are shown behavior of coconut charcoal and a high surface area carbon as adsorbents for hydrogen in a cryopump element.
Figure 5:
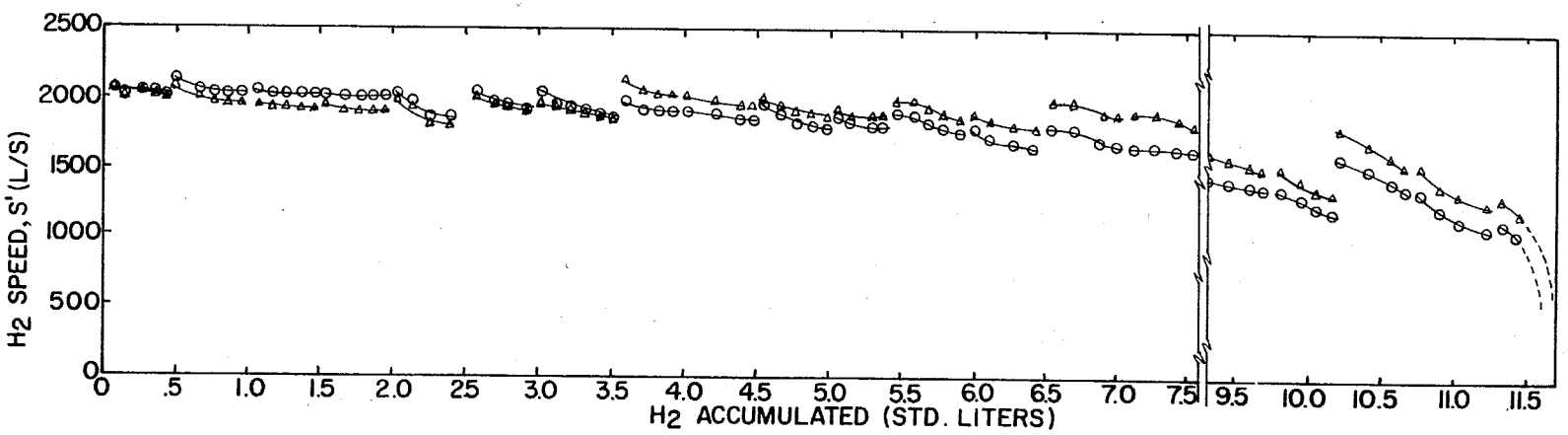

Results are shown in FIG. 4 for prior art coconut charcoal and in FIG. 5 for the Amoco carbon. From this figures, it is clear that the prior art charcoal adsorbed 1.9 SL of hydrogen before the speed dropped to half its initial value. The Amoco charcoal adsorbed 11.4 SL of hydrogen, before the speed dropped to half its initial value. Thus, the panel made from high surface, large particles of Amoco carbon adsorbed about six times as much as the prior art charcoal.

From FIGS. 4 and 5, it is also apparent that the larger than conventional particles of high surface area Amoco carbon produced a cryopump panel, in which initial pumping speed was the same as that of a panel constructed from small particles of conventional carbon and that the high initial pumping speed was maintained until the panel of Amoco carbon granules was nearly saturated with hydrogen.

After these evaluations, attempts were made to estimate the actual amounts of the receptive carbons on the panels. The adsorbent carbons were removed from a representative unit area of the panel, taking care to detach most of the carbon and also to minimize the removal of the adhesive, and were subsequently weighed. The amounts of carbon used in each panel were thus estimated to be 27 g for the coconut charcoal panel and 40 g for the Amoco carbon panel respectively.

EXAMPLE 6

(a) Standard coconut charcoal (3.6 g, 3×2 mm, 6×16 mesh) was adhered to a hat-shaped cold panel (U.S. Pat. No. 4,514,204) with epoxy adhesive. The panel was evaluated in an apparatus containing a second stage hydrogen vapor bulb thermometer and an encapsulated silicon diode, attached to a cold station. The cryopump panels comprised a warm panel, which was painted totally with black thurmalox and had a 5/6 nickel-plated louver; and the cold panel prepared above, which was the top stack of an AP-8S panel. The compressor was an IRO4W OI, with a nominal equilibrium pressure of $1.75\times10^5$ kg/m$^2$. Hoses were standard 1.27 cm×457 cm hoses. The test dome contained a Granville/Phillips model 274021 ionization gauge operated by a series 260 controller and a DV6M TC gauge tube operated by an APD-R controller.

The cryopump panel and test dome were evacuated to about 31 microns, using a Sargent-Welsh mechanical rotating pump. Cryopump cooldown was initiated and the roughing valve was closed. After the system had reached minimum temperature (−264° to −263° C.) and pressure, initial pumping speeds were measured and hydrogen accumulation at $1\text{-}2\times10^{-6}$ torr was determined. After completion of the test, the system was warmed to room temperature under a dry stream of nitrogen.

(b) A similar panel was prepared, using 3.6 g of Amoco GX-31 carbon (3×3 mm, 6×8 mesh), also adhered to the panel with epoxy adhesive. The behavior of the panel was evaluated as in (a).

Figure 6:
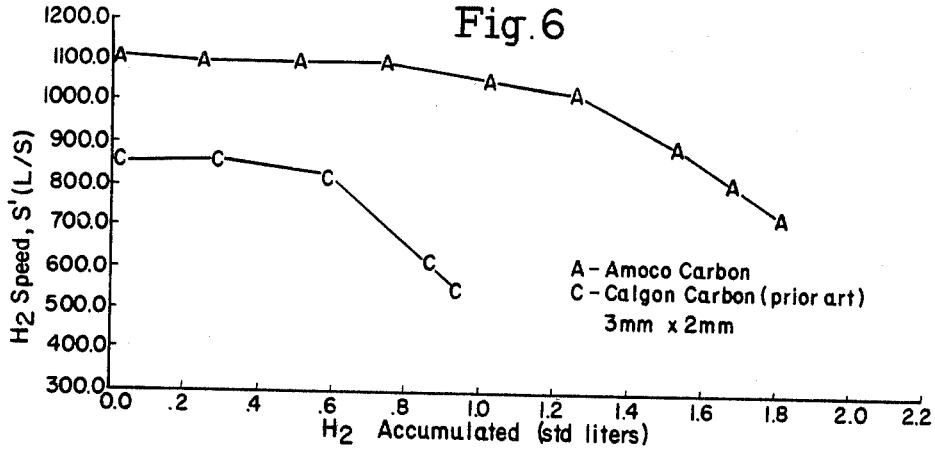
In FIGS. 6 and 7 are shown comparisons of the behavior of large particles of prior art and high surface carbons in cryopump elements.

The following results, also shown in FIG. 6, were obtained:

| | Amoco Carbon | Coconut Charcoal |
|---|---|---|
| Initial pumping speed (L/s) | 1100 | 850 |
| Hydrogen capacity (L) at 50% of initial pumping speed | 2 | 0.9 |

These results show that a panel made from large particles of high surface area carbon had a higher initial pumping speed than a panel made from large particles of a conventional carbon, as well as high capacity. These results are surprising in view of Hands, supra.

EXAMPLE 7

Figure 7:
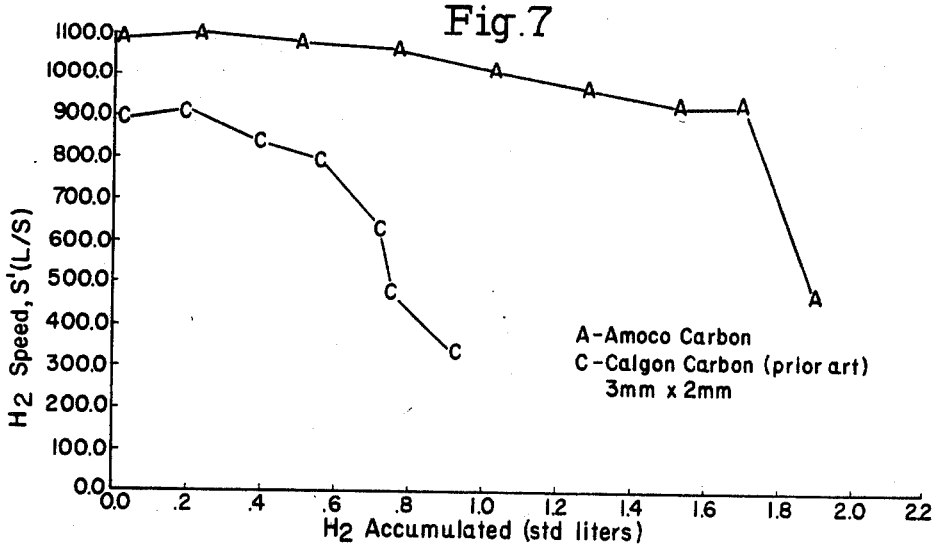

Panels were made as in Example 6. The evaluations were carried out at $1\text{-}2\times10^{-5}$ torr and −264° to −263° C. Results, also shown in FIG. 7, were:

| | Amoco Carbon | Coconut Charcoal |
|---|---|---|
| Initial pumping speed (L/s) | 1100 | 900 |
| Hydrogen capacity (L) at 50% of initial pumping speed | 1.9 | 0.76 |

The panel made from large particles of conventional carbon accordingly had a lower initial pumping speed, as well as lower capacity, than the panel made from high surface area granules of even larger particle size.

EXAMPLE 8

Figure 8:
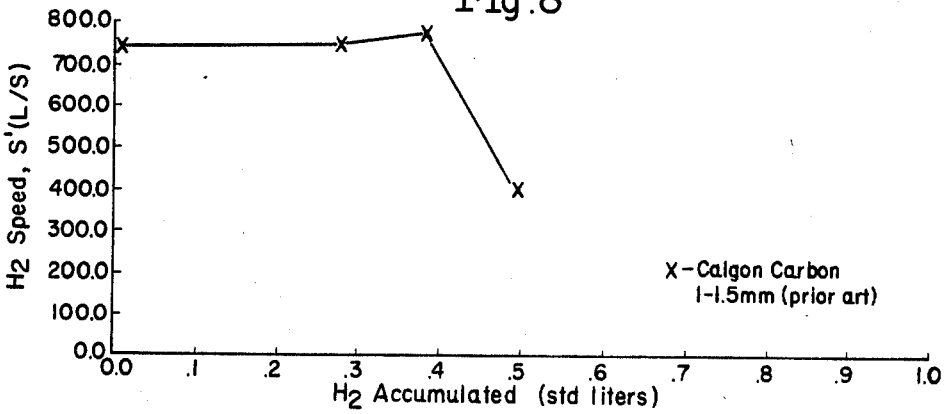
In FIG. 8 is shown the behavior of small granules of carbon in a cryoadsorption pump panel.

A panel was made as above, using Calgon carbon (1×1.5 mm). The panel was evaluated at $1\text{-}2\times10^{-5}$ torr at −264° to −263° C. The initial pumping speed was 750 L/s and the hydrogen capacity at 50% of initial pumping speed was 0.48 L. As shown in FIG. 8, this small particle size, low surface area carbon exhibited a relatively constant pumping speed, until near saturation, whereas the panels made from larger granules of convention carbons (FIGS. 6 and 7) did not.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

We claim:

1. In a high vacuum pump comprising a cryoadsorption pumping element and means for cooling the pumping element to the cryogenic temperature range, the improvement wherein the pumping element comprises porous carbon particles having a nitrogen BET apparent surface area above about 1500 m$^2$/g and dimensions greater than about 1.5×1.5×1.5 mm.

2. The pump of claim 1, wherein the porous carbon particles have a bulk density greater than about 0.25 g/cm$^3$ and a cage-like structure which contributes to over 60% of its surface, as measured by phase contrast, high resolution microscopy.

3. The pump of claim 1, wherein the porous carbon particles have a nitrogen BET apparent surface area above about 2000 $m^2/g$.

4. The pump of claim 1, wherein the porous carbon particles have a nitrogen BET apparent surface area above about 2200 $m^2/g$.

5. The pump of claim 1, wherein the porous carbon particles have dimensions greater than about 2×2×2 mm.

6. The pump of claim 1, wherein the porous carbon particles have a nitrogen BET apparent surface area greater than 2300 $m^2/g$, made by treating a carbonaceous feed with hydrous potassium hydroxide in an amount of 0.5–5 weights per weight of carbonaceous feed; precalcining the mixture of hydrous potassium hydroxide and carbonaceous feed at 315°–482° C. for 15 min-2 h and calcining the thus pre-calcined feed at 704°–982° C. for 20 min-4 h under an inert atmosphere.

7. The pump of claim 1, wherein the pumping element is a panel, having pressed thereon porous carbon particles of nitrogen BET apparent surface area above about 2000 $m^2/g$ and dimensions above about 2.5×2.5×2.5 mm.

8. A panel assembly for a cryoadsorption pump, comprising a high thermal conductivity metal panel adapted for cooling by a cryogenic fluid, the metal panel having mounted thereon porous carbon particles having a nitrogen BET apparent surface area above 1500 $m^2/g$ and dimensions greater than 1.5×1.5×1.5 mm.

9. The panel assembly of claim 8, wherein the porous carbon particles have a bulk density greater than about 0.25 $g/cm^3$ and a cage-like structure which contributes to over 60% of its surface, as measured by phase contrast high resolution microscopy.

10. The panel of claim 8, wherein the porous carbon particles have a nitrogen BET apparent surface area above about 2000 $m^2/g$.

11. The panel of claim 8, wherein the porous carbon particles are affixed to the metal panel by pressing.

12. The panel of claim 8, wherein the porous carbon particles are applied to the metal panel in the form of pellets.

13. The panel of claim 8, wherein the porous carbon particles have dimensions above about 2×2×2 mm.

14. The panel of claim 13, wherein the panel is a cylindrical surface.

15. The panel of claim 13, wherein the panel is an extended surface.

16. The panel of claim 13, wherein the panel is a surface of revolution.

17. The panel of claim 8, wherein the porous carbon particles have a nitrogen BET apparent surface area above about 2200 $m^2/g$ and are applied to the panel in the form of pellets.

18. The panel of claim 8, wherein the panel is an extended surface and the porous carbon particles have a nitrogen BET apparent surface area above about 2000 $m^2/g$ and dimensions above about 2×2×2 mm.

19. A method for maintaining high initial hydrogen pumping speed, characteristic of adsorbent carbons of 1–1.5 mm or smaller in a high vacuum pump comprising a cryoadsorption pumping element and means for cooling the pumping element to the cryogenic temperature range, comprising using in the cryoadsorption pump the panel assembly of claim 18.

20. A method for maintaining high initial hydrogen pumping speed, characteristic of adsorbent carbons of 1–1.5 mm or smaller in a high vacuum pump comprising a cryoadsorption pumping element and means for cooling the pumping element to the cryogenic temperature range, comprising using in the cryoadsorption pump the panel assembly of claim 8.

21. A method for maintaining high initial hydrogen pumping speed, characteristic of adsorbent carbon particles of 1–1.5 mm or smaller, in a high vacuum pump comprising a cryoadsorption pumping element and means for cooling the pumping element to the cryogenic temperature range, comprising using as pumping element porous carbon particles having a nitrogen BET apparent surface area above 1500 $m^2/g$ and dimensions above about 1.5×1.5×1.5 mm.

22. The method of claim 21, wherein the porous carbon particles have a bulk density greater than about 0.25 $g/cm^3$ and a cage-like structure which contributes to over 60% of its surface, as measured by phase contrast, high resolution microscopy.

23. The method of claim 21, wherein the porous carbon particles have a nitrogen BET apparent surface area above about 2000 $m^2/g$ and dimensions greater than about 2×2×2 mm.

* * * * *